United States Patent [19]

Justice

[11] Patent Number: 5,059,064

[45] **Date of Patent: * Oct. 22, 1991**

[54] HORIZONTAL DEWATERING SYSTEM

[76] Inventor: Donald R. Justice, P.O. Box 458, Matlacha, Fla. 33909

[ * ] Notice: The portion of the term of this patent subsequent to May 22, 2007 has been disclaimed.

[21] Appl. No.: 525,838

[22] Filed: May 21, 1990

Related U.S. Application Data

[63] Continuation-in-part of Ser. No. 324,700, Mar. 17, 1989, Pat. No. 4,927,292.

[51] Int. Cl.[5] ..... E02B 11/00; E02B 13/00; B05B 17/08

[52] U.S. Cl. ..... 405/37; 405/43; 239/20; 239/63; 239/724

[58] Field of Search ..... 405/37, 43, 44, 45, 405/48; 239/60, 63, 67, 310, 724, 725

[56] References Cited

U.S. PATENT DOCUMENTS

| | | | |
|---|---|---|---|
| 2,226,915 | 12/1940 | Trowbridge | 239/20 |
| 2,949,861 | 8/1960 | Heath | 166/106 |
| 3,876,000 | 4/1975 | Nutter | 166/106 |
| 3,966,233 | 6/1976 | Diggs | 405/48 |
| 4,180,348 | 12/1979 | Taylor | 405/43 X |
| 4,268,993 | 5/1981 | Cunningham | 405/37 X |
| 4,372,389 | 2/1983 | Hamrick et al. | 166/106 X |
| 4,391,551 | 7/1983 | Belcher | 405/43 |
| 4,871,281 | 10/1989 | Justice | 405/181 |
| 4,927,292 | 5/1990 | Justice | 405/43 |

*Primary Examiner*—Randolph A. Reese
*Assistant Examiner*—Arlen L. Olsen
*Attorney, Agent, or Firm*—Fleit, Jacobson, Cohn, Price, Holman & Stern

[57] ABSTRACT

Water is removed from an underground perforated pipe by a submersible pump inserted into an imperforate pipe extending from above ground to below ground level for communication with the perforated pipe. An inflatable bladder seals the submersible pump to the inner wall of the imperforate pipe for facilitating suction of water from the perforated pipe into the imperforate pipe. Water is drawn into a proximal end of the pump and expelled out of a distal end of a pump, and out of the imperforate pipe above ground level. By sealing the pump to the inner wall of the imperforate pipe, the pump is capable of drawing water from an underground perforated pipe located at a depth greater than the pumping capacity of the pump for drawing up water.

20 Claims, 12 Drawing Sheets

HORIZONTAL DEWATERING SYSTEM

This application is a continuation-in-part application of application Ser. No. 07/324,700, filed Mar. 17, 1989, now U.S. Pat. No. 4,927,292.

FIELD OF THE INVENTION

This invention is related to a method and apparatus for lowering the water table by evacuating a length of buried horizontal well pipe through vertically extending header.

BACKGROUND OF THE INVENTION

It is known that at a construction site or along a proposed path of underground utility lines, it is necessary to lower the water table level. One method for lowering the water table is the use of horizontal well pipe. The well pipe is placed at the bottom of a trench and then backfilled with the evacuated earth or with substitute fill conveyed to the trench. A suction pump is attached at an above-ground end of the pipe to continuously draw up water that enters perforations in a horizontal portion of the well pipe until the water table is lowered.

The pump located above-ground is capable of pumping the water up to the ground level from a certain depth according to the capacity of the pump. However, conventional pumps have a limited suctioning capability for drawing up water. Typically, the average limit is on the order of 18 feet of water through a certain diameter pipe. Therefore, in situations where it is necessary to remove water from an underground pipe located at a depth greater than 18 feet, it is inefficient for above-ground pumps to draw up water.

SUMMARY OF THE INVENTION

Horizontal dewatering perforated pipe is laid at the bottom of a trench by a trenching machine, as disclosed in applicant's U.S. Pat. No. 4,871,281, which is hereby incorporated by reference. By the present invention, a pump is placed in a bottom portion of an imperforate or perforated header section connected to the buried horizontal perforated pipe to pump water up from below ground. A discharge port is provided at the proximal end of the pump and a suction port is provided at a distal end of the pump.

The pump may include an inflatable bladder surrounding the pump. The inflatable bladder is expanded around the pump casing to engage with the interior surface of the imperforate portion of the pipe for sealing off the pipe and creating a vacuum in the pipe below the suction port. Furthermore, the inflatable sealing bladder surrounds the pump casing between the proximal and distal ends to isolate the suction port from the discharge port.

When the pump is energized, water is sucked up and out of the underground perforated pipe via the suction port and is expelled through the discharge port into an imperforate pipe portion or header located above the pump. The discharged water accumulates in the pipe above the discharge port and eventually is pumped to an outflow opening in the pipe which is located above ground level. The inflatable sealing bladder may be attached to or form a part of the submersible pump assembly, or alternatively may take the form of an inflatable jacket which the submersible pump is inserted into prior to insertion into the pipe.

It is also advantageous to use the present system and method to recycle irrigation water on a farm. Water used to irrigate crops passes through the soil and carries with it many of the nutrients and fertilizers used to cultivate the crops. By burying extended lengths of perforated pipe at a suitable depth below the soil, the water is collected by the sections of perforated pipe as it seeps through the soil and is drawn up by the pump located at the bottom of the imperforate header section so as to recycle the irrigation water for additional irrigational purposes. The nutrients carried away by the irrigation water are thereby captured and prevented from descending to the water table, where certain of the chemicals applied to the crops may produce a potential health hazard if continuously leeched into the water supply.

Additionally, the present system and method may be used at landfill sites by burying extended lengths of perforated pipe at the base of an existing landfill or a new landfill prior to its use. As the refuse and other landfill material is deposited into the landfill, rainwater and other water applied to the refuse material to lower the risk of fire is captured by the perforated pipe as it descends through the ground. The descending water is captured within the perforated sections of pipe and pumped through the imperforate header section by a pump located at the junction of the imperforate and perforate pipe sections to pump the water up and back onto the landfill or to a landfill retention area or leachate treatment plant. When the water is pumped back onto the landfill, a portion of the water will evaporate and a portion, again, will pass through the landfill material to the perforated pipe sections. This continuous recycling of contaminated water prevents the water from ultimately descending to the water table and contaminating the water supply.

It is a primary object of the present invention to provide a system for pumping water with a pump from an underground pipe located at a depth typically greater than the above-ground pumping capabilities of the pump.

It is an additional object of this invention to provide a system for removing water from an underground well discharge pipe through the use of a pump inserted inside a header pipe and locating the pump proximate to an underground perforated pipe portion of the well discharge pipe, and having an inflatable bladder for sealing off a portion of the pipe below the pump adjacent the underground perforated pipe portion, thereby creating a vacuum for increasing the pumping capacity and efficiency of the pump.

It is yet another object of the present invention to provide a system for removing water from an underground discharge pipe which includes an imperforate pipe portion extending from above ground level to the underground discharge pipe portion, including a submersible pump assembly for insertion into the imperforate pipe portion and for positioning the pump adjacent the underground discharge pipe at a perforated pipe portion.

The above objects and advantages will become more apparent when reference is made to the following description taken in conjunction with the accompanying drawings.

DETAILED DESCRIPTION OF THE PREFERRED EMBODIMENTS

Figure 1:
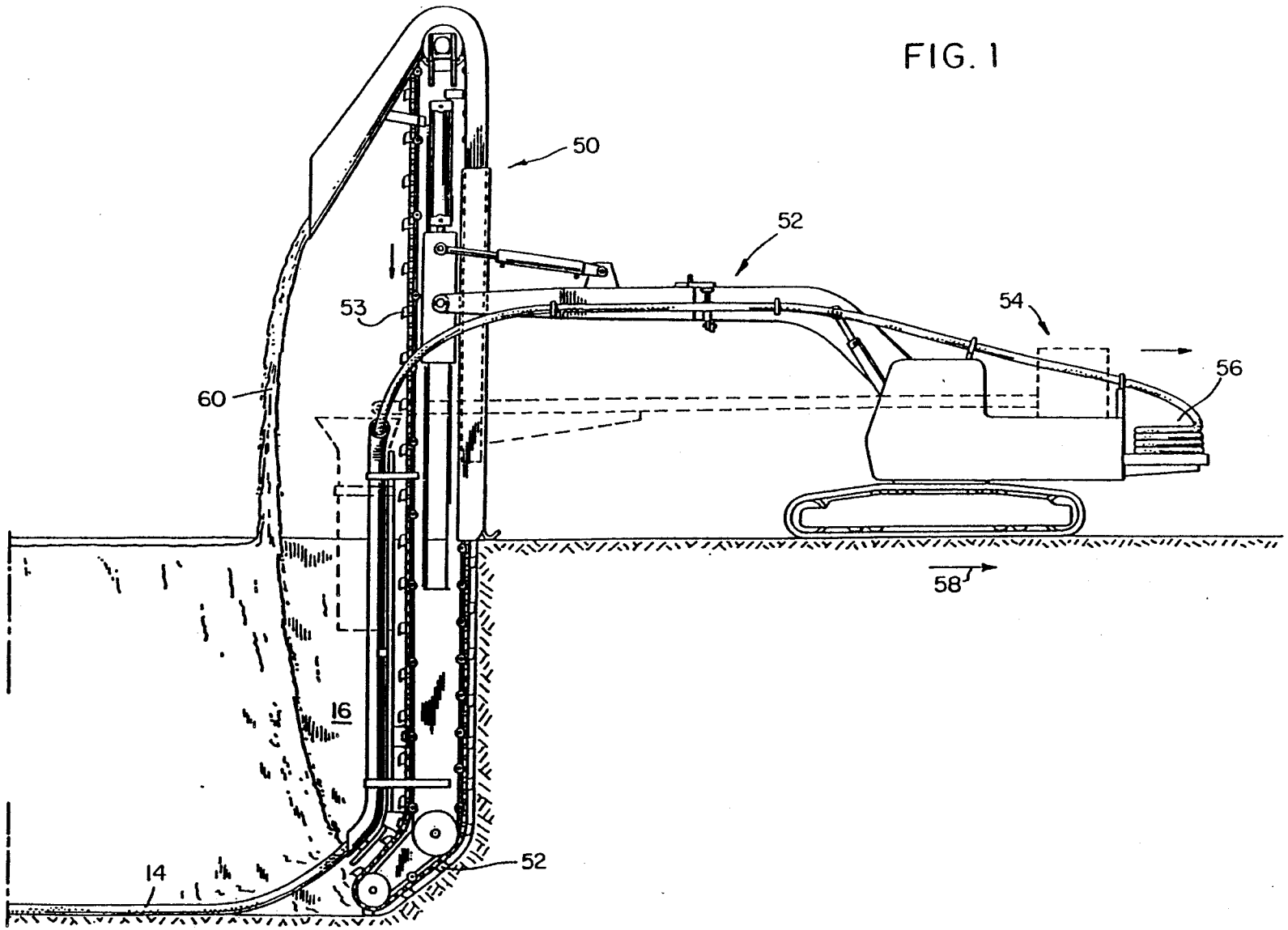
FIG. 1 is a schematic diagram of a trenching tool digging a trench, laying perforated pipe at the bottom of the trench, and backfilling the trench to cover the perforated pipe.

In describing a preferred embodiment of the invention illustrated in the drawings, specific terminology will be used for the sake of clarity. However, the invention is not intended to be limited to the specific terms selected, and it is to be understood that each specific term includes all technical equivalents which operate in a similar manner to accomplish a similar purpose.

In FIG. 1, trenching tool 50 is shown mounted on an end of a boom 52, which is connected to tractor 54. The trenching tool 50 includes a series of cutting blades 52 mounted on an endless conveyor to dig a trench 16 along a path desired to introduce a horizontal dewatering pipe to lower the water table or to collect water as it descends through the earth. Along the bottom of the trench is laid a perforated drain pipe 14, which is fed from a supply reel 56 on the tractor 54 to feed the perforated pipe as the tractor moves in the direction of arrow 58. One end of the pipe 14 is sealed which is initially buried in the trench. The opposite terminal end is open for connection to an imperforate pipe, as will be explained later.

The trench 16 is backfilled to ground level by the soil 60, previously removed to form the trench, or by additional fill conveyed to the trench.

After a sufficient length of perforate pipe 14 has been buried at the bottom of the trench, the perforate pipe is cut, and the terminal end 62 of the perforated pipe 14 is connected to an imperforate T-coupling 64 at one end 66. Another end 68 of the coupling is sealed. The third opening 70 of the T-coupling is connected to imperforate discharge pipe or header 12, which extends from an above ground discharge 72 to the end 70 of the T-coupling 64. The opposite open end 62 of the perforated pipe is connected to end 66 of T-coupling 64 to provide communication between the imperforate pipe 12 and the perforated pipe 14.

Imperforate discharge pipe or header 12 is of a corrugated configuration having inner wall 13, the purpose of which will be explained hereinafter.

Figure 3:
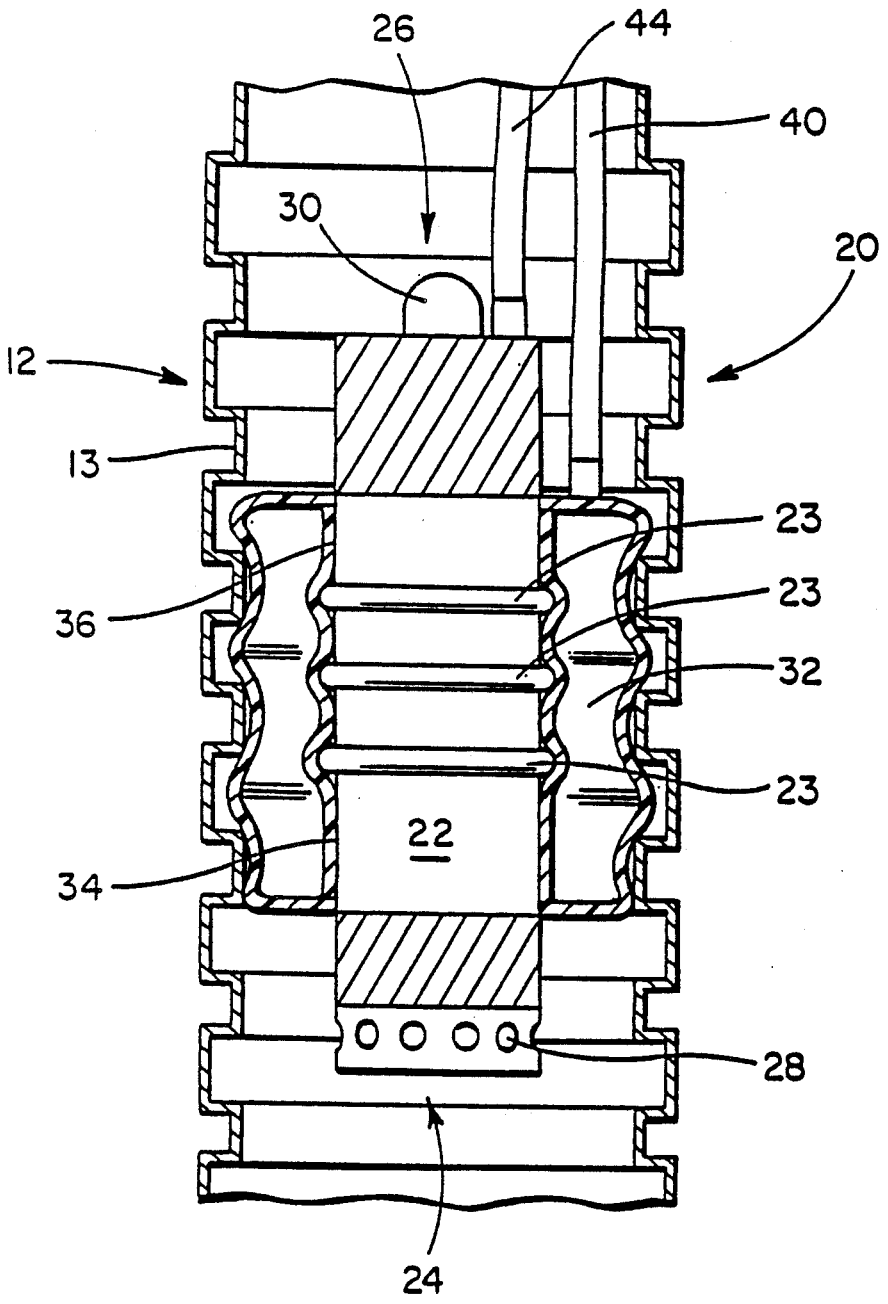
FIG. 3 is an enlarged sectional view taken through line 3—3 of FIG. 2.

Water removal system 10 includes a submersible pump assembly 20, shown in detail in FIG. 3. Pump assembly 20 includes a pump 22 having a distal end 24 and a proximal end 26. Pump 22 includes a suction port 28 located at the distal end 24, and a discharge port 30 located at the proximal end 26.

In addition, pump assembly 20 includes an annular inflatable bladder 32 for sealing the annular region between the pump and the discharge pipe 12. Rings 23 are provided around the pump 22 for engaging with the bladder 32. Preferably, bladder 32 is securely attached to pump 22 at flat end surfaces 34 and 36, adjacent the distal and proximal ends 24 and 26, respectively. The bladder 32 is expanded by air pressure to frictionally conform around rings 23 for further sealing to the pump 22.

Alternatively, bladder 32 can take the form of an expandable jacket which is not attached to the pump 22. In this case, the pump 22 is inserted into the jacket, and rings 23 assist in holding the jacket on and around the pump 22 in position.

Figure 2:
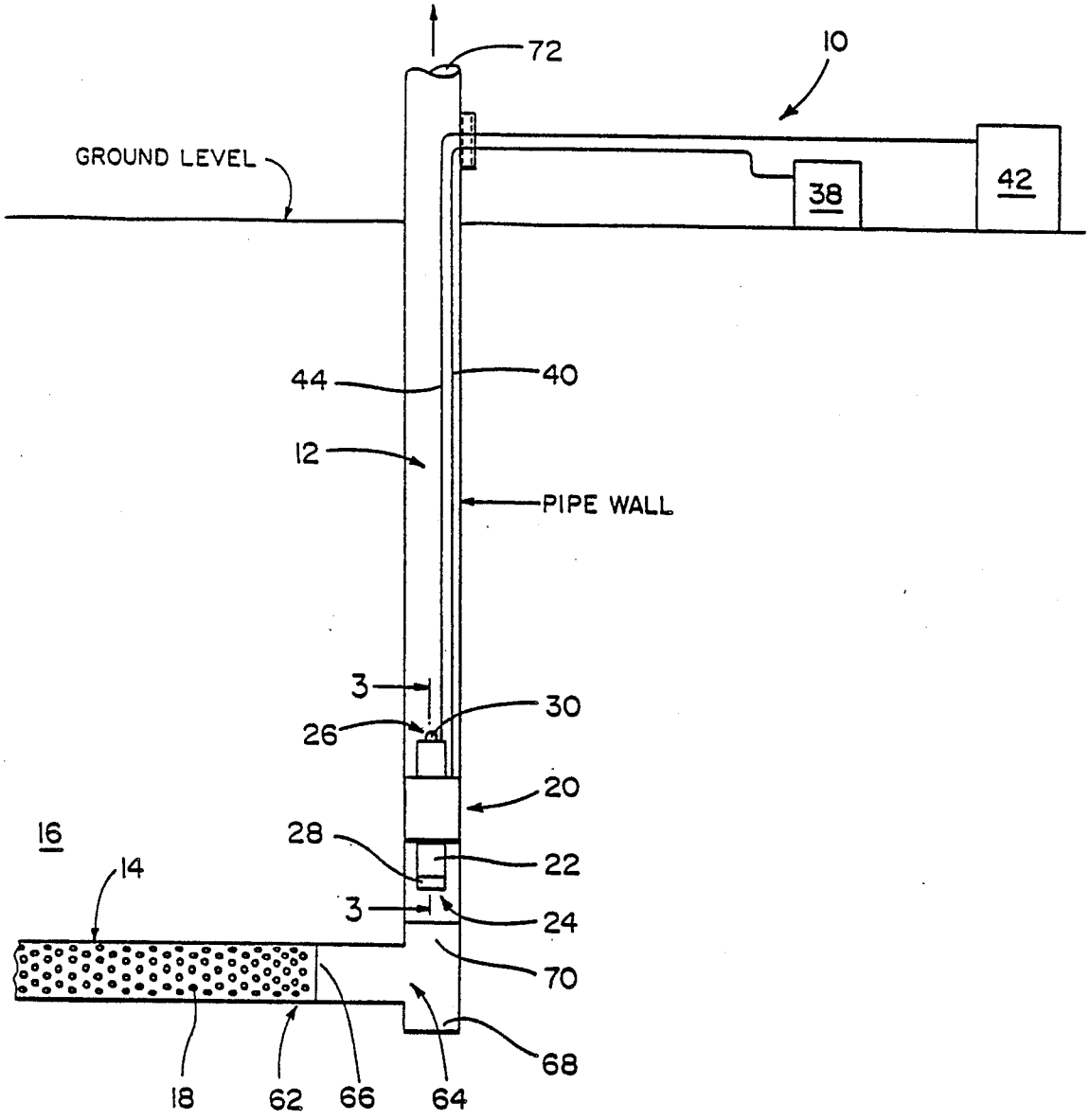
FIG. 2 is a schematic diagram illustrating the water removal system of the present invention, including perforated pipe laid in conjunction with the trenching tool and connected to an imperforate header.

In operation, pump assembly 20 is inserted into discharge pipe 12 and positioned proximate to the terminal end 62 of perforated pipe portion 14, as illustrated in FIG. 2. A source of air pressure 38 is provided above-ground and connected to the inflatable bladder 32 via a flexible tubing 40. The bladder 32 is thereby inflated and sealed in position around pump 22. In addition, a source 42 of electrical energy or hydraulic pressure is provided above-ground and connected to pump 22 via insulated cable 44 to power the pump.

Once the pump assembly 20 is in position, bladder 32 is inflated sufficiently by air pressure to firmly engage and surround pump 22 and also engage the corrugated inner wall 13 of imperforate pipe 12. In this way, the annular opening between pipe 12 and pump 22 is sealed, and a vacuum is created in pipe 12 below suction port 28 to allow imperforate pipe portion 12 to be utilized as a discharge pipe. Furthermore, by sealing the pump 22 inside imperforate pipe 12, and creating a vacuum in pipe 12 below the suction port 28 and adjacent to the source of water to be pumped, the pumping efficiency of pump 22 is increased.

After the pump 22 is sealed in pipe 12, suction is applied through port 28 to remove water entering the perforated pipe 14. As water is drawn up, the pump expels the water out of the discharge port 30. Water is then forced above the proximal end of pump 26 and is finally expelled out of an open discharge end 72 of pipe 12 above ground level. Since the pump 22 is lowered to approximately a distance less than its rated capacity above the perforated drain portion containing the water, the pumping capacity of pump 22 is easily handled and prolongs the life of pump 22. Therefore, such a system as described herein can employ standard pump devices, but further their capabilities for removing water at greater depths.

Additional uses of the water recovery system described with respect to FIGS. 1 to 3 will now be set forth.

The average 18-hole championship golf course requires irrigation of 70–90 acres of fairway, tees and greens. The volume of water required to irrigate 80 acres on a per annum basis is approximately ninety-four million (94,000,000) gallons. The source of irrigation waters have traditionally been vertical wells in deep aquifers and surface water impoundments, such as in lakes within a golf course.

On an average-day basis, two hundred fifty-seven thousand (257,000) gallons per day may be required for golf course irrigation, but a peak day requirement can be four hundred sixty-five thousand (465,000) gallons per day. The peak day needs are experienced during dry, hot and low rainfall months, which also is the time that impounded surface waters, such as lakes, are low to non-existent and deep aquifers are strained from heavy pumping and withdrawals to meet other water needs such as public potable water supply, commercial/industrial, agriculture and additional irrigational needs.

This water supply source problem continues to grow, with little being accomplished to supplement or relieve the same. The basic regulatory approach is to limit and restrict consumptive use in order to protect the available resource.

The present invention, as shown in FIGS. 4 to 6 and FIGS. 7 to 9 provides a new and unique means of providing the ability to utilize shallow surficial aquifers as a supplemental water source for golf courses and other irrigation requirements.

Figure 5:
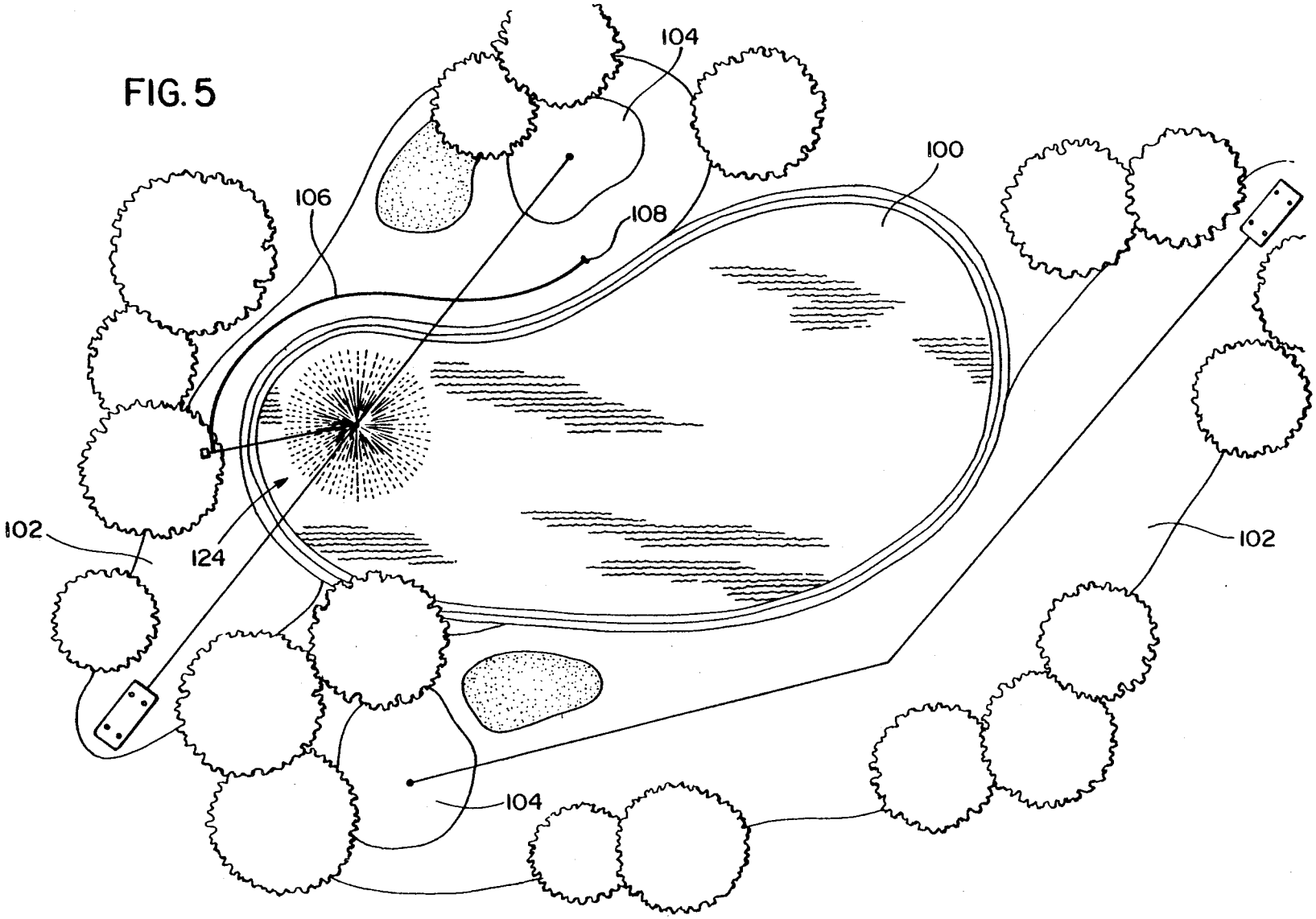
FIG. 5 is a plan view of the water recovery system shown in FIG. 4.
Figure 6:
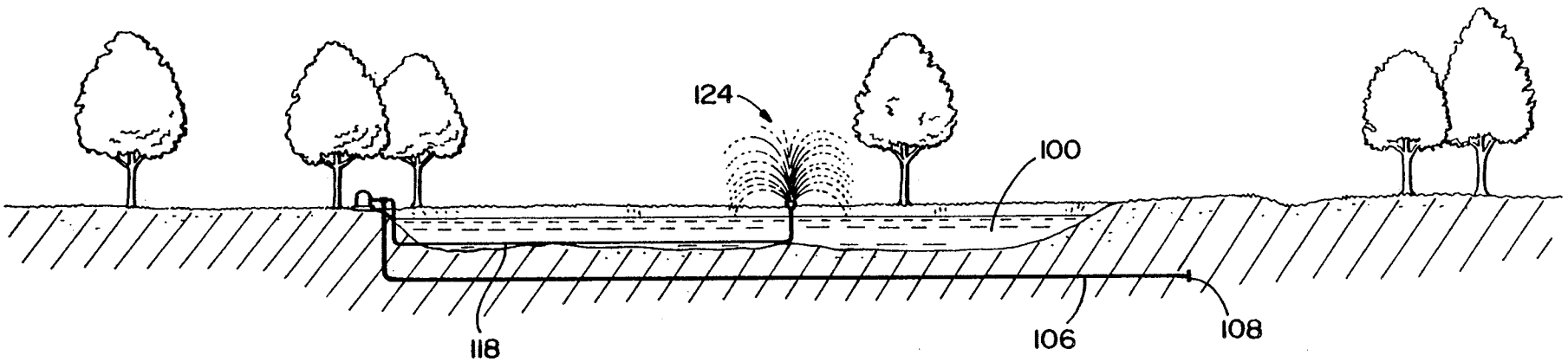
FIG. 6 is a partial sectional view of the water recovery system shown in FIG. 4.

The shallow surficial aquifer, such as lake 100 in FIG. 5, is directly recharged by rainfall, as is the surface water impoundment supply (drainageways and lakes). This aquifer is also directly recharged by a fair percentage (35–40%) of the irrigation process and by exfiltration of lake and drainageway waters from the wetted areas thereof (percolation and side bank leaching).

The present invention provides the ability to recover recharging waters and recycle the same for irrigation uses, plus provides a source of supplemental waters for maintaining impoundment lake levels to protect the environmental habitat attendant therewith.

Two additional beneficial features are attendant to utilizing the present invention for a golf course irrigation water source, which are:

1. The systems allow for increasing the capture and beneficial use of ground waters which are directly recharged by surface waters and/or rainfall, thereby minimizing the "runoff" and adding to the ability to provide enhanced retention of the same.
2. Many golf courses have "playing areas" that are constructed on ground surfaces that are marginal for other development and therefore conducive only to recreational uses.

These areas tend to be "low" and "wet", which provide major drainage problems in order to maintain suitable playing surfaces.

The present invention, when installed in such areas, is not only a good water supply source, but also provides the ability to control the water table elevations to minimize, if not eliminate, the "wet area" problem on fairways and other.

Figure 4:
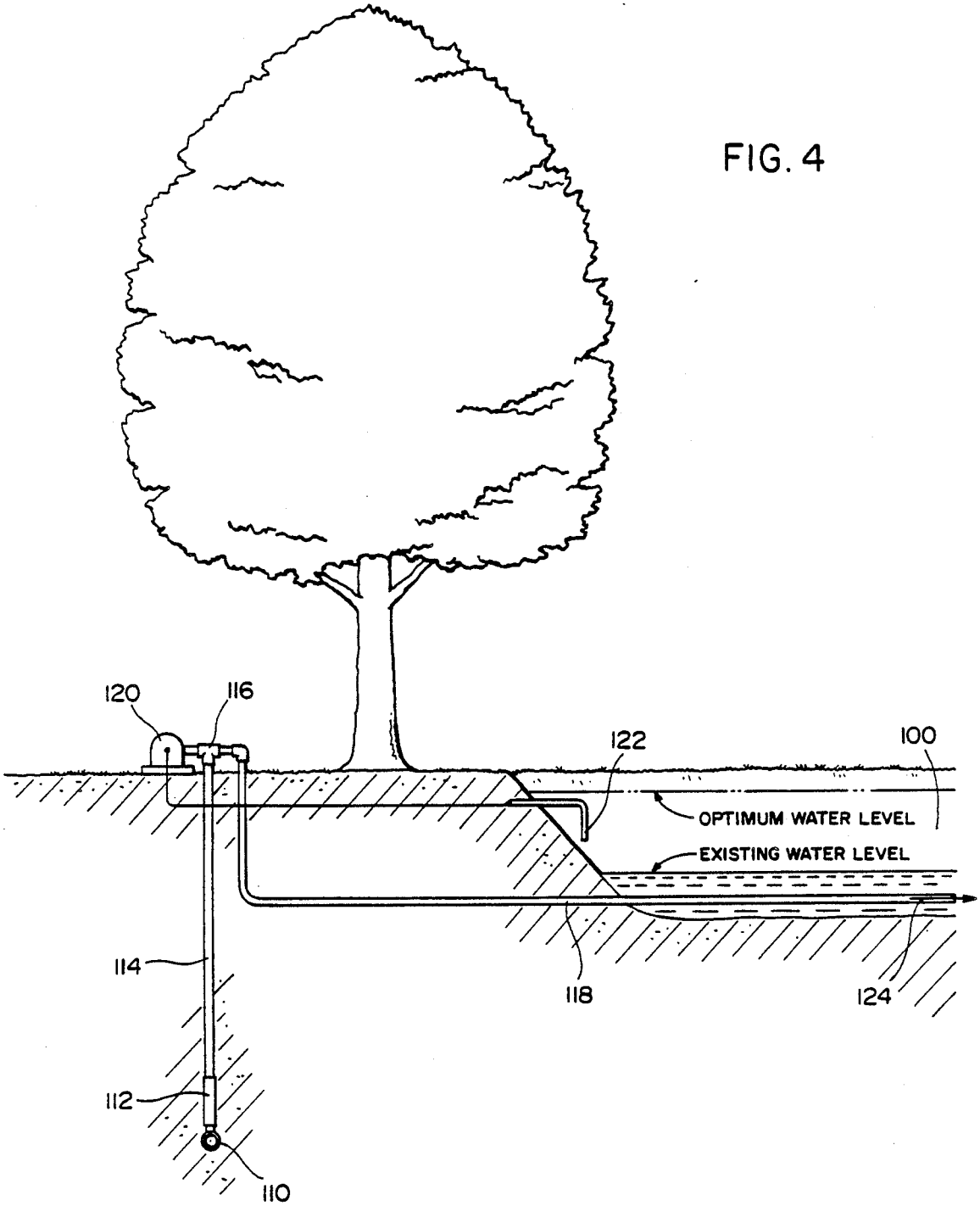
FIG. 4 is a partial sectional view of a water recovery system for maintaining a water level of a lake.

As shown in FIG. 5, lake 100 is located adjacent to a golf course fairway 102, having green 104. The present invention for water recovery is implemented by laying four hundred±feet of a five-inch±diameter water recovery pipe 106 below the fairway 102 of the golf course. The water recovery pipe, identical to pipe section 14 of FIG. 2 includes an end cap 108. At an opposite end of water recovery pipe 106 from end cap 108 is connection 110, as shown in FIG. 4. A submersible pump assembly 112, consistent with the teachings of FIGS. 2 and 3, is located within a five-inch± diameter vertical pipe 114 which is connected above ground at connection 116 to a four-inch±discharge line 118.

At connection 118 is mechanical control equipment 120 which obtains a signal from sensor 122, such as a float, for measuring the existing water level of lake 100. When the sensor 122 determines that the water level has fallen below a predetermined minimum, pump 112 is energized by control equipment 120 to draw up water through recovery pipe 106. The recovery pipe 106 also helps maintain the golf course free of wet areas by controlling the depth of the water table.

The water is pumped through vertical pipe 114 through connection 116 to discharge line 118. A fountain 124 may be located at the end discharge line 118 to force recovered water through the fountain 124 up into the air above the lake 100 so as to elevate the level of water in the lake 100. The lake 100 is thereby available as a continuous source for watering of the fairways tees and greens of a golf course.

Figure 8:
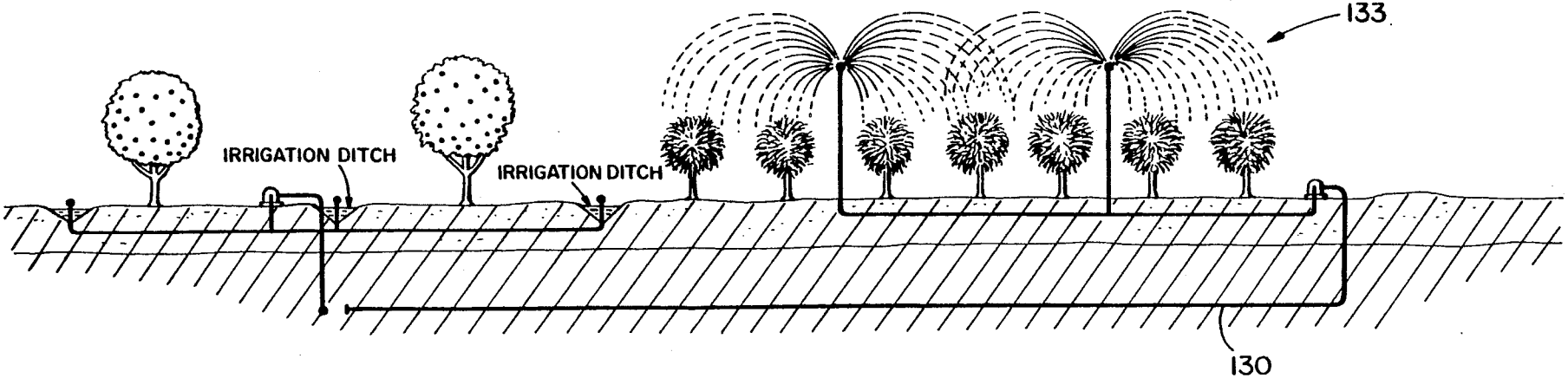
FIG. 8 is a partial sectional view of the water recovery system shown in FIG. 7 on an enlarged scale.
Figure 7:
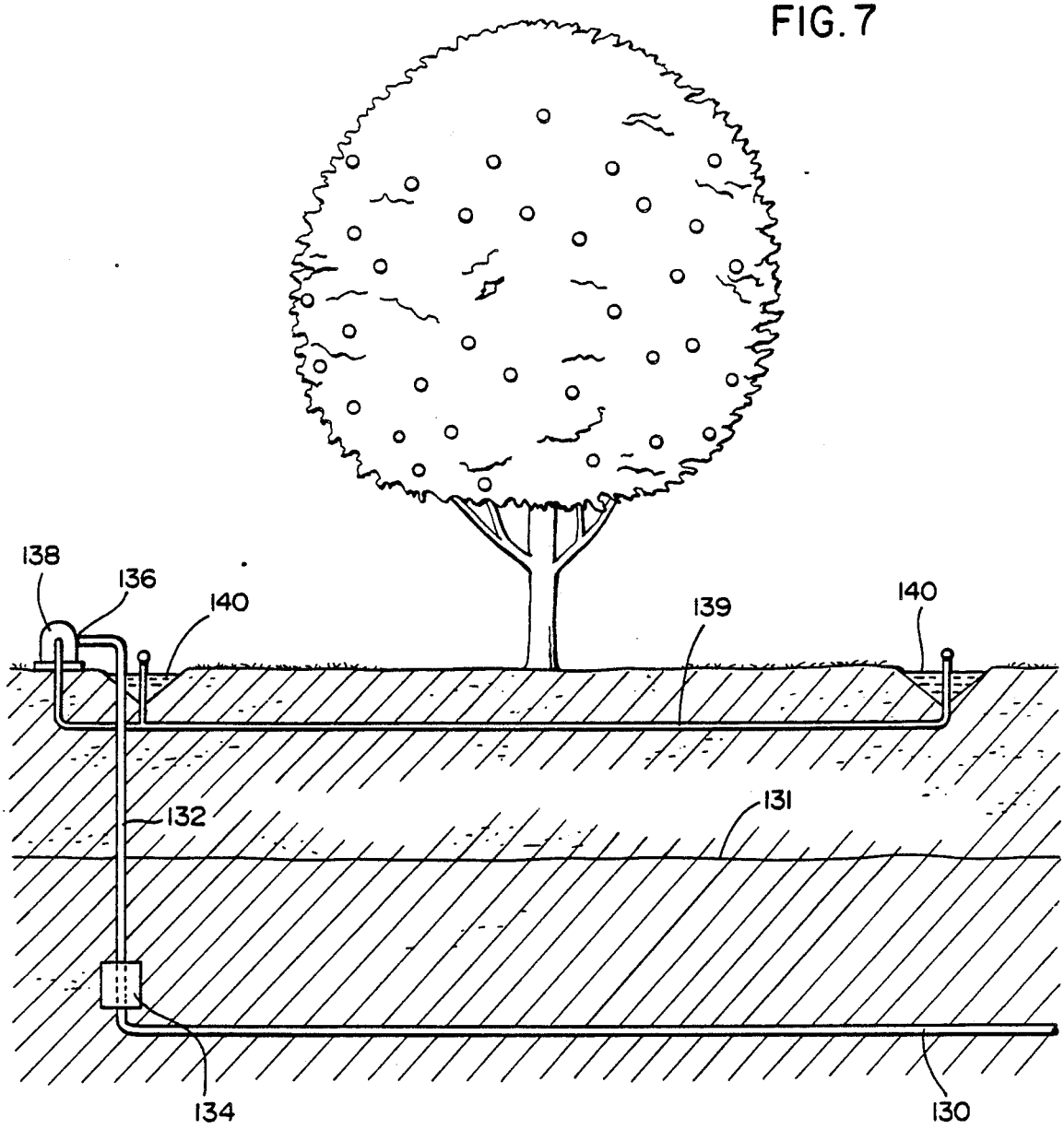
FIG. 7 is a partial sectional view of an agricultural water recovery and reuse system.

Similarly, in FIGS. 7 through 9, a five-inch±diameter water recovery pipe 130 is located below the water table 131 for collection of water. At one end of the recovery pipe 130 is a five-inch±diameter vertical pipe 132, including therein a submersible pump assembly 134 for pumping the collected water to an above ground connection 136 with a water pump distributor 138 for pumping water through distribution line 139 to distribute water into irrigation ditches 140. In conjunction with the distribution to irrigation ditches 140, connection may be made for distribution to a recovered water sprinkler system 133 used to distribute water over such procedure as tomatoes, lettuce, cauliflower, broccoli and squash.

Figure 9:
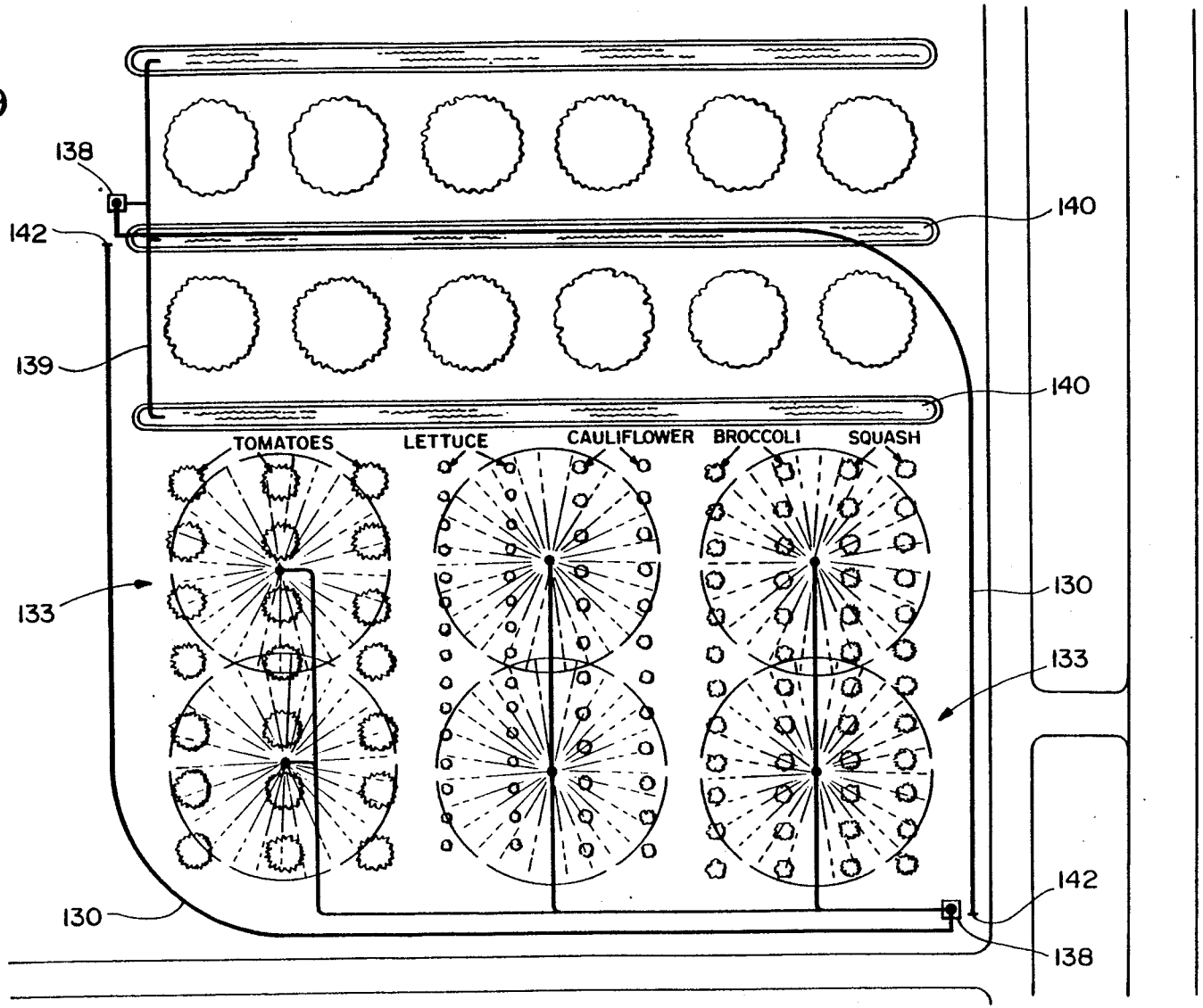
FIG. 9 is a plan view of the water recovery system shown in FIG. 8.

As shown in FIG. 9, two systems are shown having two five-inch±diameter water recovery pipes 130 with end caps 142 with the systems connected to above ground booster pumping equipment (if required) 138 for distribution of the recovered water by distribution lines 139 to either a sprinkler system 133 or to irrigation ditches 140. It is noted that one of the water recovery lines 130 may even run underneath and parallel to an irrigation ditch 140 so as to recapture the water percolating through the earth from the irrigation ditch. The submersible pump assembly system for water recovery shown in FIGS. 7 through 9 is the same as shown in FIGS. 2 and 3.

Figure 10:
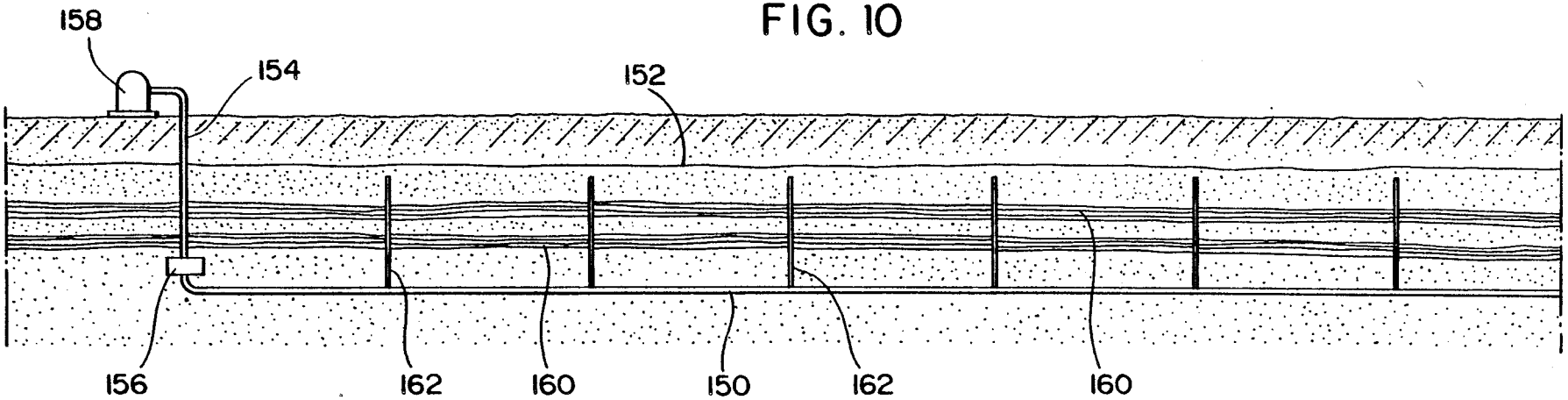
FIG. 10 is a partial sectional view of a commercial and domestic water recovery and reuse system with impervious layer conditions.
Figure 11:
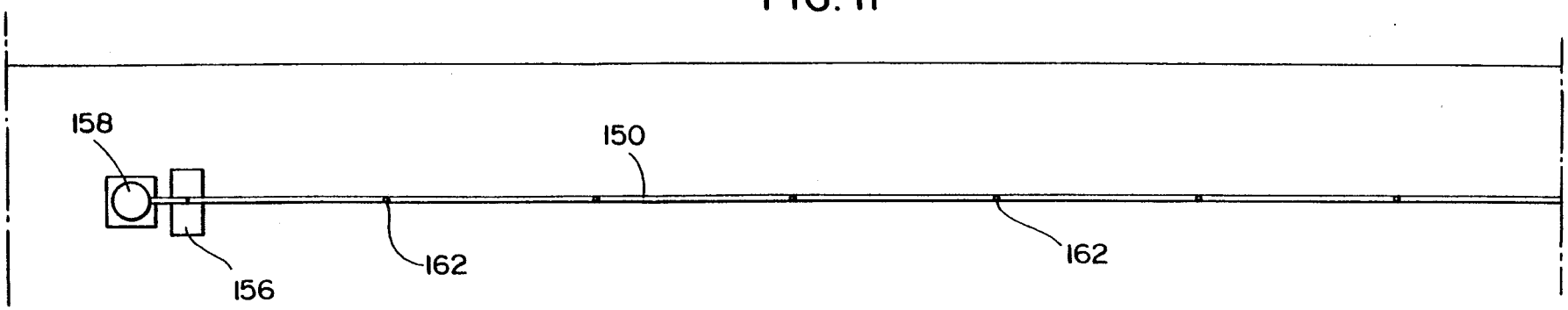
FIG. 11 is a plan view of the pipe system for the water recovery system shown in FIG. 10.

In FIGS. 10 and 11, a water recovery pipe 150 is shown located below the water table 152 for collection of water. Similar to FIGS. 2 and 3, the recovery pipe is connected to a five-inch±diameter vertical pipe 154 having a below ground pump 156 therein for pumping water to the distribution pump equipment 158, which is located above ground. In this particular embodiment, several impervious layers 160 are distributed through the strata of the earth. These impervious layers prevent the migration of water down through the impervious layers to the water recovery pipe 150.

Therefore, a plurality of vertically extending five-inch diameter water recovery pipes 162 at twenty-foot intervals are distributed along the length of the water recovery pipe 150 so as to collect water and allow passage of the water vertically downward to water recovery pipe 150. The recovery pipes 162 pass through the impervious layers and thereby overcome the blockage of the migration of water to the recovery pipe 150.

Figure 12:
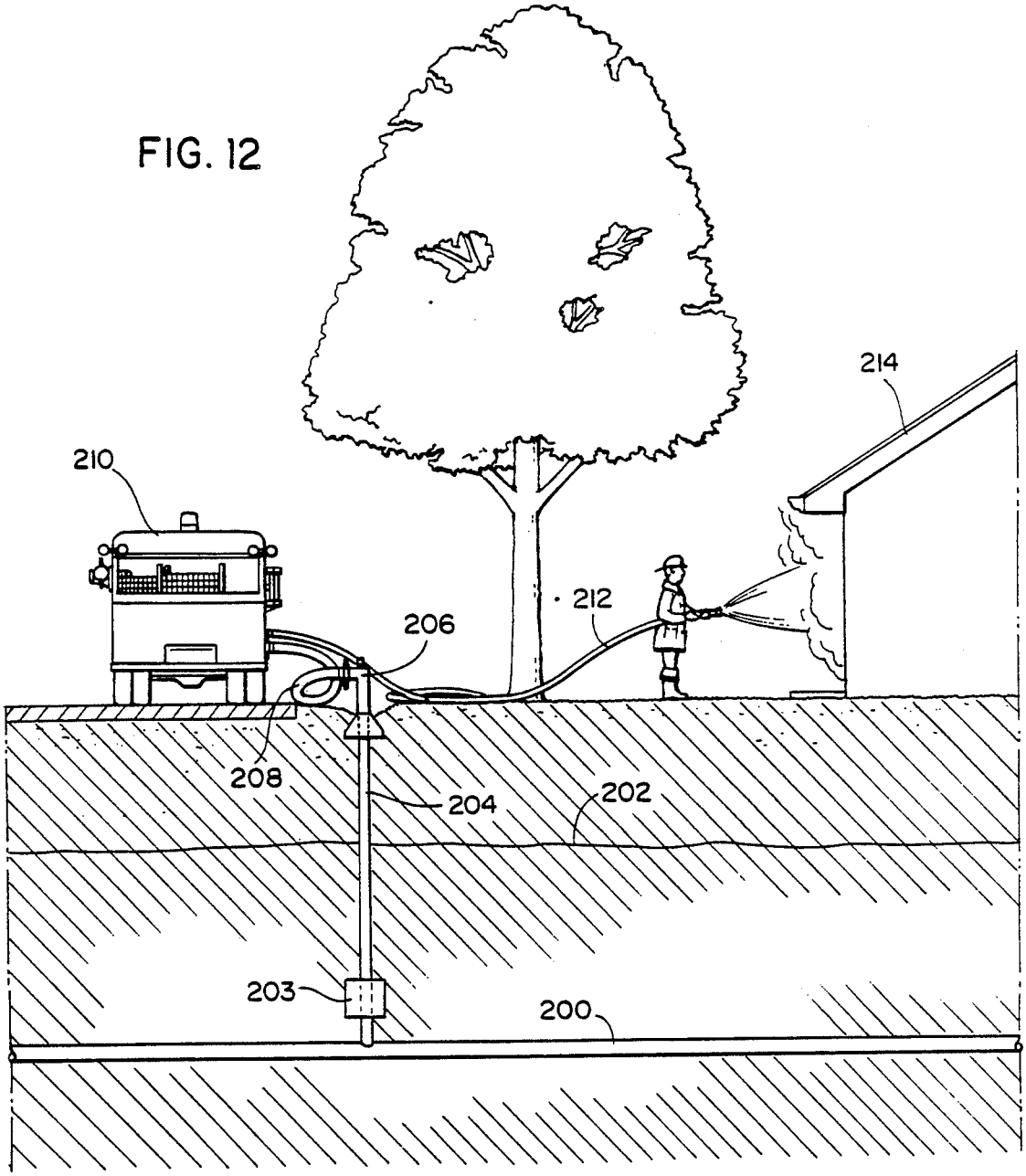
FIG. 12 is a partial sectional view of a fire protection system for rural and remote areas.
Figure 13:
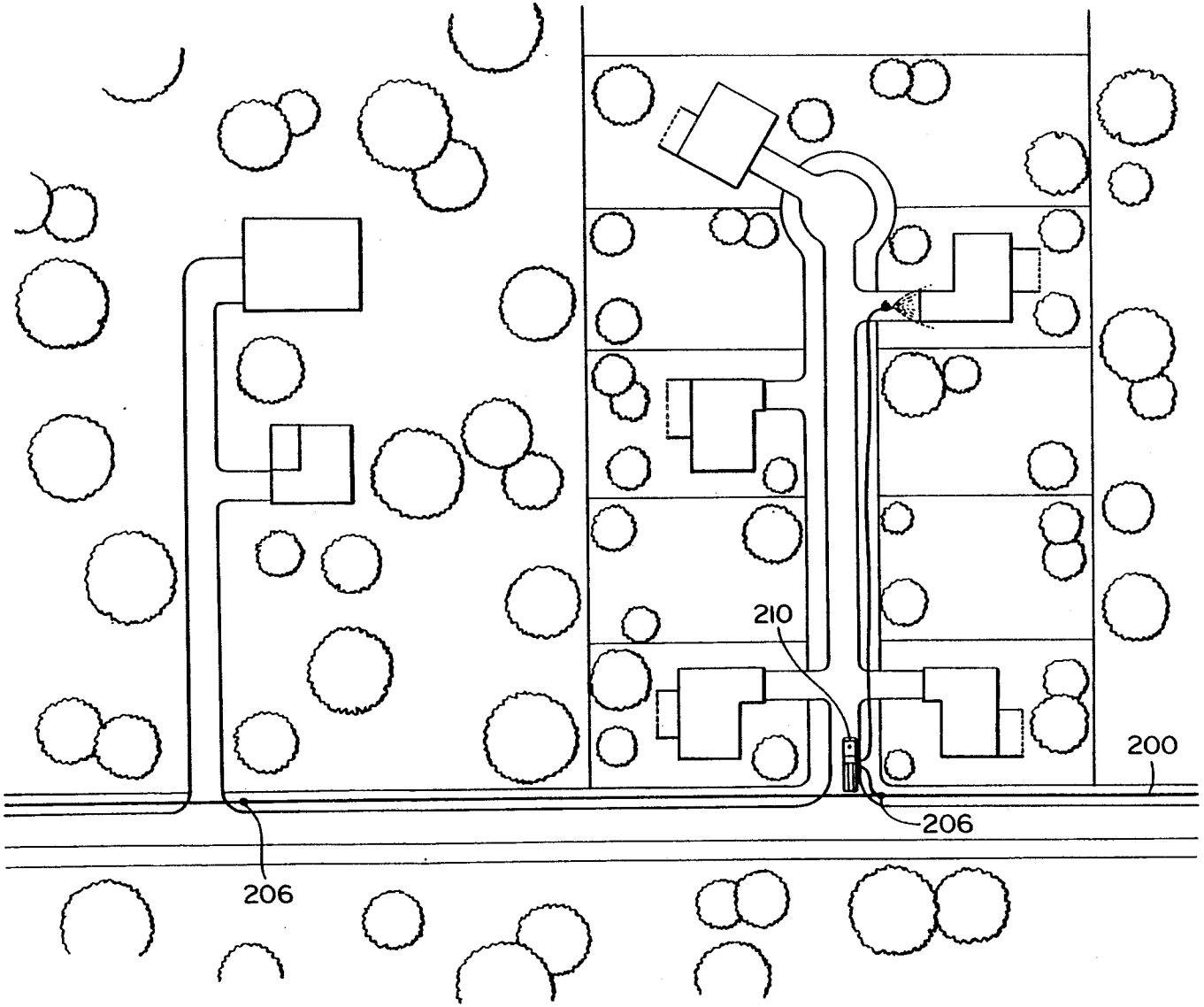
FIG. 13 is a plan view implementing the water recovery system shown in FIG. 12.

In FIGS. 12 and 13, a water recovery system is shown having the ability to utilize surficial aquifer waters, heretofore non-accessible in sufficient quantities, to provide the public and firefighting professionals with adequate water to reasonably control and suppress safely and effectively, residential fires in rural and remote areas not served by water systems with adequate fire water flow from distribution water mains and standard fire hydrants attendant thereto.

The system comprises the utilization of semi-monolithic filter cloth, horizontal recovery pipe sized in accordance with measured aquifer yields, riser pipe and 360 degree hydrant capped pumping stand pipes connected thereto which allows fire protection pumping units to connect to the stand pipes with maximum speed and minimum of pumper repositioning to successfully eliminate suction or discharge fire hose kinking, twisting, folding or otherwise inhibiting full sustained flows therein.

Water has, for centuries, been utilized in the firefighting process, and its limitations in rural and remote areas of residences primarily has been its immediate availability in sustained quantities for durations necessary to adequately allow the firefighting professionals to do their job.

Mobile pumping units utilizing open surface water bodies as a sustained source or for recharging mobile tanker (water hauling) units to fight respective rural and remote area fires, has long been a practice and is addressed as the best method available under the physical restraints of the location by a given fire and the water supply source to allow the suppression, containment and extinguishing thereof.

Normal vertical residential supply and irrigation wells are designed, installed and equipped to supply only about ten percent (10%) of the minimum fire flow requirements of five hundred gallons per minute (500 GPM); the recommended amount to provide for two (2) standard hose streams on a given fire.

The system of the present invention provides the means to recover/withdraw adequate volumes of water for the firefighting process while utilizing the surficial aquifer/ground water as the storage area in the immediate vicinity of such installations.

The system of the present invention not only provides an economically-viable means to provide additional protection of the public safety, property and well being, it further provides conservation of energy, minimization of capital expenditure requirements and the sustaining of large central water systems extended to rural and remote areas with potable water quantities and capacities to meet the minimum fire protection standards therefore.

The horizontal filter cloth recovery pipe, in varying diameters, installed into the aquifer at depths varying from sixteen feet (16') to thirty feet (30') and in lengths of five hundred lineal feet (500±L.F.) in a given direction provides a ground water area sphere of influence in excess of the conventional source recovery methods and, because of its utilization only on an emergency basis, is environmentally sound and acceptable.

The continuous trenching, pipe installation to specified gradients and attendant backfilling in varying trench widths, provide a ground water flow interface into natural soils that have been loosened and aerated by the trenching excavation process to allow a higher degree of water transfer to the receiving filter pipe than from natural consolidated soils immediately adjacent to a vertically drilled well.

Further, when given ground area conditions produce impermeable soil layers (hard pan, clay) that are penetrated by the filtered recovery pipe by the continuous trenching installation method, the ability to intercept this perched water is significantly greater than by a single or multiple small diameter well holes.

The "cone of depression" (water level drawdowns) of the present system is unique and advantageous for aquifer water recovery because the continuous trenching and filter pipe installation on controlled gradients provides an open continuity of the subsurface ground area not presently available.

The present invention, by its unique monolithic nature, allows for a uniform drawdown, and the water transfer is enhanced by the filter recovery pipe and its controlled gradient which moves the water from the point of collection along the installed recovery pipe to the controlled pumping point, thereby uniformly drawing down the aquifer and simplifying the pumping controlled operation in a cost effective and sustained yield manner.

Further, the ability of the present system to enhance the storage and immediate yield capacity of the filter cloth recovery pipe envelope (trench area) is increased by the simultaneous addition of coarse granular fill materials (crushed/washed aggregates). The granular fill materials, by their physical composition, provide additional voids for "free water" storage and subsequent release to the system.

The hydrant capped stand pipe is designed to provide maximum flexibility in the location of the firefighting personnel's pump unit. The hydrant can be rotated to any given direction, thereby reducing the required time of "positioning" the pumping unit, thus allowing the actual fire suppression activities to proceed faster. The fire hose threads on the hydrant capped stand pipe are specified to meet the hose thread standard of any given community or fire fighting entity.

Another major consideration in providing fire flow protection to residential areas is the spacing of the fire hydrants which normally are designed for commercial, industrial and high-density residential use at five hundred foot (500') intervals, while in rural and remote residential areas, the intervals can be expanded. The system of the present invention accommodates the five hundred foot (500') spacing by the installation of a hydrant capped stand pipe on each end of the recovery system and the pumping withdrawal being made from the closest unit to the fire emergency to be served.

This system further has the unique ability to be able to connect two (2) runs of the horizontal filter cloth recovery pipe to a single hydrant capped stand pipe, thereby increasing the immediate resource reserve and enhancing the sustained yield and its duration by a factor of two, where the aquifer yields and reserve might suggest the same is advisable.

In FIG. 12, an eight-inch water recovery pipe 200 is located below the water table 202. As in the previous embodiments, the water recovery pipe 200 is connected to a vertical stand pipe 204 having a submersible pump assembly unit 203, located within the pipe 204.

In this embodiment, the vertical stand pipe 204 is capped by a rotatable hydrant 206, connectable by a hose 208 to a fire truck 210, which pumps the collected water by hose 212 onto a fire, for example, of a residence 214.

In FIG. 13, a continuous length of recovery pipe 200 is located below the water table. At intervals of a thousand feet (1000') or as required by local fire codes, are hydrants 206, which are located at the top of vertical headers 204, having a submersible pump assembly 203 located within the header 204, as is shown in FIGS. 2 and 3.

Figure 14:
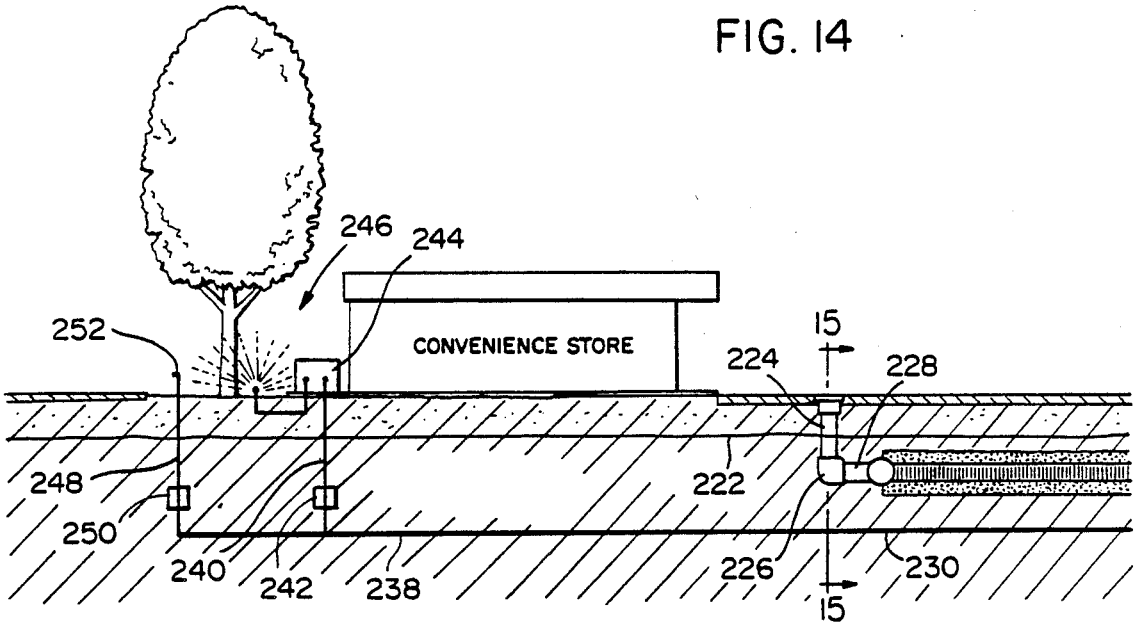
FIG. 14 is a partial sectional view of a water recovery and reuse program for runoff and ground water for remote areas.
Figure 15:
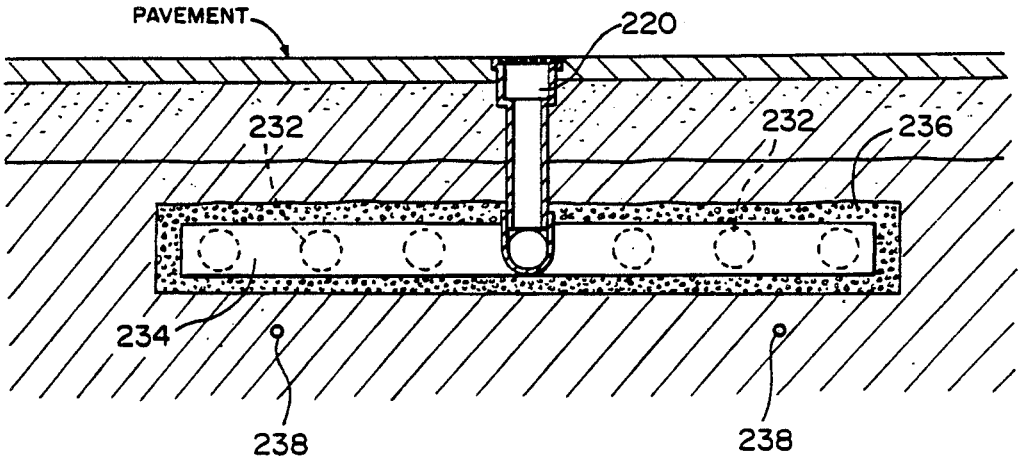
FIG. 15 is a sectional view taken through line 15—15 of FIG. 14.

In FIGS. 14 and 15, a water recovery system is shown including a catch basin 220 for collecting runoff water or water produced at a remote commercial site such as a car wash. The grade is sloped to direct the water to the catch basin 220 which is passed below ground and below the water table 222 by a vertical pipe 224. At a right angle connection 226, water is passed to a pipe 228, which is connected to a distribution pipe 230 having a plurality of perforated, corrugated pipes 232 emanating therefrom.

The plurality of perforated, corrugated pipes are located in a retention and catchment system 234 contained within a crushed aggregate shell 236. The drain water collected in the catch basin and emanating from the perforated, corrugated pipes 232 passes through the crushed aggregate shell 236, which acts as a filter and then mixes with the water in the water table. An eight-inch diameter water recovery pipe 238 is located below the shell 236.

In FIG. 15, two water recovery pipes 238 are shown extending parallel to each other and below the shell 236. Each recovery pipe 238 is connected to a vertical header 240, having a submersible pump assembly 242 therein for pumping up water collected in the recovery pipe to a distribution box 244, which pumps water to a sprinkler system 246 for irrigation purposes. In addition, a second vertical header 248, having a submersible pump assembly 250, pumps water up to a hydrant 252 for connection to a fire truck as explained with reference to FIGS. 12 and 13.

By the embodiments of the invention described, a series of water recovery systems are shown which make use of the ever present aquifer system. The collection and distribution of the collected water by a below ground pump, efficiently and environmentally makes use of a vast untapped resource.

Having described the invention, many modifications thereto will become apparent to those skilled in the art to which it pertains without deviation from the spirit of the invention as defined by the scope of the appended claims.

I claim:

1. A water recovery system for maintaining a level of water in a body of water, said system comprising:

a body of water, a sensor for sensing a level of water in said body of water, a perforated pipe extending horizontally in a continuous direction for a substantial distance buried in a trench for seepage of water into said perforated pipe, one end of said perforated pipe being sealed and an opposite end of said perforated pipe being open, an imperforate pipe extending vertically from above ground level and being in communication with said open end of said perforated pipe, said imperforate pipe including a discharge outlet located above ground level, a submersible pump assembly located within said imperforate pipe, said pump assembly including a pump, said pump having proximal and distal ends, a discharge port being located at said proximal end and a suction port being located at said distal end of said pump, sealing means for sealing said pump within said imperforate pipe to an inner wall of said imperforate pipe, said sealing means isolating said discharge port and said suction port from each other and said pump assembly creating a vacuum in a portion of said imperforate pipe adjacent to said perforated pipe, energy means for powering said pump so that a vacuum is created to draw water into said suction port of said pump from said perforated pipe, discharged out of said discharge port of said pump to said proximal end of said pump, pumped through a portion of said imperforate pipe located above said pump and forced to said discharge outlet of said imperforate pipe above ground level, control means for activating said pump upon receiving a signal from said sensor means indicative of a water level in said body of water below a predetermined water level, and a discharge pipe connected to said imperforate pipe for conveyance of water pumped from said perforated pipe to said body of water.

2. A water recovery system as claimed in claim 1, wherein said discharge pipe is connected to a sprinkler system for sprinkling water over said body of water.

3. A water recovery system as claimed in claim 1, wherein said perforated pipe is buried adjacent to said body of water.

4. A water recovery system as claimed in claim 3, wherein said perforated body is buried below a fairway of a golf course.

5. An irrigation system for irrigating a field, said system comprising:

a perforated pipe extending horizontally in a continuous direction for a substantial distance buried in a trench for seepage of water into said perforated pipe, one end of said perforated pipe being sealed and an opposite end of said perforated pipe being open, an imperforate pipe extending vertically from above ground level and being in communication with said open end of said perforated pipe, said imperforate pipe including a discharge outlet located above ground level, a submersible pump assembly located within said imperforate pipe, said pump assembly including a pump, said pump having proximal and distal ends, a discharge port being located at said proximal end and a suction port being located at said distal end of said pump, sealing means for sealing said pump within said imperforate pipe to an inner wall of said imperforate pipe, said sealing means isolating said discharge port and said suction port from each other and said pump assembly creating a vacuum in a portion of said imperforate pipe adjacent to said perforated pipe, energy means for powering said pump so that a vacuum is created to draw water into said suction port of said pump from said perforated pipe, discharged out of said discharge port of said pump to said proximal end of said pump, pumped through a portion of said imperforate pipe located above said pump and forced to said discharge outlet of said imperforate pipe above ground level, and a distribution pipe for distributing water from said discharge outlet so as to irrigate a field.

6. An irrigation system as claimed in claim 5, wherein said distribution pipe extends to an irrigation ditch for delivery of water to said irrigation ditch.

7. An irrigation system as claimed in claim 6, wherein said distribution pipe is located below said irrigation ditch.

8. An irrigation system as claimed in claim 5, wherein said distribution pipe is connected to a sprinkler system for sprinkling water over a field.

9. A system for removing water from an underground pipe located at a predetermined depth below ground level and below several impervious layers, said system comprising:

a perforated pipe extending horizontally in a continuous direction for a substantial distance buried in a trench for seepage of water into said perforated pipe, an imperforate pipe extending vertically from above ground level and being in communication with said perforated pipe, said imperforate pipe including a discharge outlet located above ground level, a plurality of vertically extending perforated pipes extending from and above said horizontally extending perforated pipe for collecting and feeding water through at least one impervious layer to said horizontally extending pipe, a submersible pump assembly located within said imperforate pipe, said pump assembly including a pump, said pump having proximal and distal ends, a discharge port being located at said proximal end and a suction port being located at said distal end of said pump, sealing means for sealing said pump within said imperforate pipe to an inner wall of said imperforate pipe, said sealing means isolating said discharge port and said suction port from each other and said pump assembly creating a vacuum in a portion of said imperforate pipe adjacent to said perforated pipe, energy means for powering said pump so that a vacuum is created to draw water into said suction port of said pump from said perforated pipe, discharged out of said discharge port of said pump to said proximal end of said pump, pumped through a portion of said imperforate pipe located above said pump and forced to said discharge outlet of said imperforate pipe above ground level.

10. A system for removing water as claimed in claim 9, wherein said vertically extending perforated pipes are spaced twenty feet from each other.

11. A fire fighting system comprising:

a perforated pipe extending horizontally in a continuous direction for a substantial distance buried in a trench for seepage of water into said perforated pipe, at least one imperforate pipe extending vertically from above ground level and being in communication with said perforated pipe, said imperforate pipe including a discharge outlet located above ground level, a submersible pump assembly located within said imperforate pipe, said pump assembly including a pump, said pump having proximal and distal ends, a discharge port being located at said proximal end and a suction port being located at said distal end of said pump, sealing means for sealing said pump within said imperforate pipe to an inner wall of said imperforate pipe, said sealing means isolating said discharge port and said suction port from each other and said pump assembly creating a vacuum in a portion of said imperforate pipe adjacent to said perforated pipe, and energy means for powering said pump so that a vacuum is created to draw water into said suction port of said pump from said perforated pipe, discharged out of said discharge port of said pump to said proximal end of said pump, pumped through a portion of said imperforate pipe located above said pump and forced to said discharge outlet of said imperforate pipe above ground level.

12. A fire fighting system as claimed in claims 11, wherein said perforated pipe is connected to a plurality of said at least one imperforate pipe spaced along said perforated pipe.

13. A fire fighting system as claimed in claim 12, wherein a fire hydrant is connected to said discharge outlet.

14. A fire fighting system as claimed in claim 11, wherein said perforated pipe is located below the water table.

15. A system for collecting run-off water, said system comprising:

a catch basin for collecting run-off water, distribution means located underground for distributing water collected by said catch basin, a perforated pipe located below said catch basin and extending horizontally in a continuous direction for a substantial distance buried in a trench for seepage of water into said perforated pipe, at least one imperforate pipe extending vertically from above ground level and being in communication with said perforated pipe, said imperforate pipe including a discharge outlet located above ground level, a submersible pump assembly located within said imperforate pipe, said pump assembly including a pump, said pump having proximal and distal ends, a discharge port being located at said proximal end and a suction port being located at said distal end of said pump, sealing means for sealing said pump within said imperforate pipe to an inner wall of said imperforate pipe, said sealing means isolating said discharge port and said suction port from each other and said pump assembly creating a vacuum in a portion of said imperforate pipe adjacent to said perforated pipe, and energy means for powering said pump so that a vacuum is created to draw water into said suction port of said pump from said perforated pipe, discharged out of said discharge port of said pump to said proximal end of said pump, pumped through a portion of said imperforate pipe located above said pump and forced to said discharge outlet of said imperforate pipe above ground level.

16. A system as claimed in claim 15, wherein said distribution means includes a plurality of horizontally extending pipes located within a retention and catchment container, said plurality of horizontally extending pipes being perforated for release of water.

17. A system as claimed in claim 16, wherein said container is made of crushed aggregate for filtering water released from said plurality of horizontally extending pipes.

18. A system as claimed in claim 15, wherein said perforated pipe is connected to two of said at least one imperforate pipe.

19. A system as claimed in claim 18, wherein said discharge outlet of one of said two imperforate pipes being connected to said sprinkler system.

20. A system as claimed in claim 19, wherein said discharge outlet of the other of said two imperforate pipes being connected to a fire fighting water distribution hydrant.

* * * * *